US007228995B2

(12) United States Patent
Carty

(10) Patent No.: US 7,228,995 B2
(45) Date of Patent: Jun. 12, 2007

(54) CLOTHING HANGER ADAPTED FOR PERSONAL USE

(76) Inventor: Deborah Muse Carty, 9 Independence Ct., Piscataway, NJ (US) 08854

( * ) Notice: Subject to any disclaimer, the term of this patent is extended or adjusted under 35 U.S.C. 154(b) by 292 days.

(21) Appl. No.: 10/803,624

(22) Filed: Mar. 18, 2004

(65) Prior Publication Data

US 2004/0182892 A1 Sep. 23, 2004

Related U.S. Application Data

(60) Provisional application No. 60/455,668, filed on Mar. 19, 2003.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 3,949,914 A | | 4/1976 | Ostroll | 223/85 |
| 4,045,899 A | | 9/1977 | Richardson | 40/322 |
| 4,137,661 A | | 2/1979 | Johansson | 40/322 |
| 4,198,773 A | | 4/1980 | Batts et al. | 40/322 |
| 5,381,938 A | | 1/1995 | Vasudeva | 223/85 |
| 5,526,968 A | | 6/1996 | Larson | 223/88 |
| 5,582,377 A | | 12/1996 | Quesada | 248/229.12 |
| 5,651,455 A | | 7/1997 | Garcia | 206/287.1 |
| 5,718,362 A | | 2/1998 | Silverman | 223/94 |
| 5,732,817 A | | 3/1998 | Plath | 206/298 |
| 5,738,255 A | | 4/1998 | Wilms | 223/92 |
| 5,809,470 A | * | 9/1998 | Monjo | 704/272 |
| 6,003,743 A | | 12/1999 | Deady | 223/96 |
| 6,012,619 A | * | 1/2000 | Lam | 223/1 |
| 6,041,985 A | | 3/2000 | Balser | 223/91 |
| 6,328,469 B1 | | 12/2001 | Banco | 383/23 |

* cited by examiner

*Primary Examiner*—Shaun R. Hurley

(57) ABSTRACT

The subject invention is a single purpose clothes hanger apparatus and structure having text messaging appendages extending laterally outwardly from the upper neck portion of the hanger. At least one additional horizontal bar from which additional articles of clothing can be attached or hanged, each such bar comprises a linear horizontal extending member equilaterally affixed below the neck portion of the hanger, the customary horizontal bar member being adapted with a receptacle such as a clear, netting, or transparent paper disposable bag for containing and exposing underwear, ties, scarves, socks, and the like. The text messaging appendages are adapted to indicate to the wearer or his or her valet, caregiver, a child, or a childcare provider the day of the week for which the garments attached to hanger are to be used along with related clothing and/or other instructions pertinent to the wearer.

3 Claims, 1 Drawing Sheet

CLOTHING HANGER ADAPTED FOR PERSONAL USE

CROSS-REFERENCE TO RELATED APPLICATIONS

Applicant relies on the Mar. 19, 2003 filing date of Applicant's Provisional Patent Application Ser. No. 60/455,668 for the invention entitled Clothing Hanger Adapted for Personal Use.

BACKGROUND OF THE INVENTION

1. Field of Invention

The present invention relates to clothes hangers combining text messaging with transparent storage bags which are especially adapted for use with conventional clothes.

2. Status of Prior Art

U.S. Pat. No. 5,381,938 issued to Vasudeva on Jan. 17, 1995 for a clothes hanger with an identification compartment. Vasudeva teaches a clothes hanger constructed of plastic and having an integral identification compartment formed by a tag frame. A hook section adapted to support the hanger in use is connected to one side of the tag frame. Pairs of arms for supporting clothing are also integrally connected to the tag frame, each arm extending from the frame at an equal distance from where the hook section is connected. The outer ends of the arms are connected by a cross-member. A cover, connected by an integral hinge to the tag frame, has a series of peripheral projections each fitting into a slot on one side of the tag frame to hold the cover against that side of the frame. An identification tag is positionable between the tag frame and the cover such that information on the tag is visible in the window of the frame. The hanger may be utilized by an individual wishing to more easily identify his/her clothing, or by an institution wishing to reduce the number of hangers removed from its premises.

Subsequently, related U.S. Pat. No. 6,041,985 issued to Balser on Mar. 28, 2000 for another limited scope structure entitled multiple purpose coat hanger. Balser's invention is a multiple purpose coat hanger member having additional appendages extending laterally outwardly from the upper neck portion of the hanger from which hanger portions additional articles of clothing can be attached, such lateral extensions comprising a plurality of linear extending members affixed to the neck portion of the hanger, such lateral extension members having attachment means for hanging clothing articles on the extreme end thereof.

Related U.S. Pat. No. 6,041,985 was issued to Balser on Mar. 28, 2000 for a multiple purpose coat hanger. The subject invention is a multiple purpose coat hanger member having additional appendages extending laterally outwardly from the upper neck portion of the hanger from which hanger portions additional articles of clothing can be attached, such lateral extensions comprising a plurality of linear extending members affixed to the neck portion of the hanger, such lateral extension members having attachment means for hanging clothing articles on the extreme end thereof.

SUMMARY OF INVENTION

A novel modified clothes hanger designed to assist the Alzheimer and other memory deficient individuals as well as young children with the daily ritual of dressing. The invention is made up of at least the item shown in FIG. 1.

Alternatively, the novel invention is a plurality of the items shown in FIGS. 1 and 2 with the parts delineated in the parts list.

The novel combination structure includes a hanger that has been modified to include text messaging of the day of the week, a daily detailed instructional message, and an accessory pouch with boldly printed descriptions of clothing pieces such as, for example, socks, underwear, a scarf, belt, etc.

The novel hanger can be a single use disposable item made of cardboard or plastic molded. It is a tool to extend the independence of memory challenged individuals. It is a teaching instrument when used to develop independence in younger children as they learn to dress themselves and select clothing according to the weather with instructions 12 indicating whether or not to deselect a specific hanger or select a specific hanger depending on the weather, for example, whether raining outside or not.

The wording in the instruction tag 12 may be used to identify the garments for the individual who can no longer remember how to select clothing. Parents can also use the hanger to plan a child's clothing for the week as well as weather related alternatives. It eases the burden for the caregivers. The novel invention and combination of features provides a tool to enable caregivers to organize clothing sets for a full week, and know that the individual will have clean and coordinated clothing. Another aspect of the invention is a method of use of the structure to enable color blind and blind individuals to wear coordinated clothing. The use of the novel structure time shifts and time concentrates the selection process so that the caregiver can perform the selection and assembly services in a defined time period such as one day or evening per week. This is a valuable and viable service to those who require assistance with coordinating clothing or for those who prefer valets to do this task.

While there has been shown and described a preferred embodiment of an improved clothing hanger structure for use by children, valets, or to assist mentally impaired persons in daily dressing and coordination of their clothing in accordance with the invention, it will be appreciated that many changes and modifications may be made therein without, however, departing from the essential spirit thereof, and it is therefore desired that the present embodiment be considered in all respects as illustrative and not restrictive, reference being made to the appended claims rather than to the foregoing description to indicate the scope of the invention.

DESCRIPTION OF THE PREFERRED EMBODIMENTS

A novel modified clothes hanger designed to assist the Alzheimer and other memory deficient individuals as well as young children with the daily ritual of dressing. The invention is made up of at least the item shown in FIG. 1. Alternatively, the novel invention is a plurality of the items shown in FIGS. 1 and 2 with the parts delineated in the parts list.

The novel combination structure includes a hanger that has been modified to include text messaging of the day of the week, a daily detailed instructional message, and an accessory pouch with boldly printed descriptions of clothing pieces such as, for example, socks, underwear, a scarf, belt, etc.

The novel hanger can be a single use disposable item made of cardboard or plastic molded. It is a tool to extend the independence of memory challenged individuals. It is a teaching instrument when used to develop independence in younger children as they learn to dress themselves and select clothing according to the weather with instructions 12 indicating whether or not to deselect a specific hanger or select a specific hanger depending on the weather, for example, whether raining outside or not.

Figure 1:
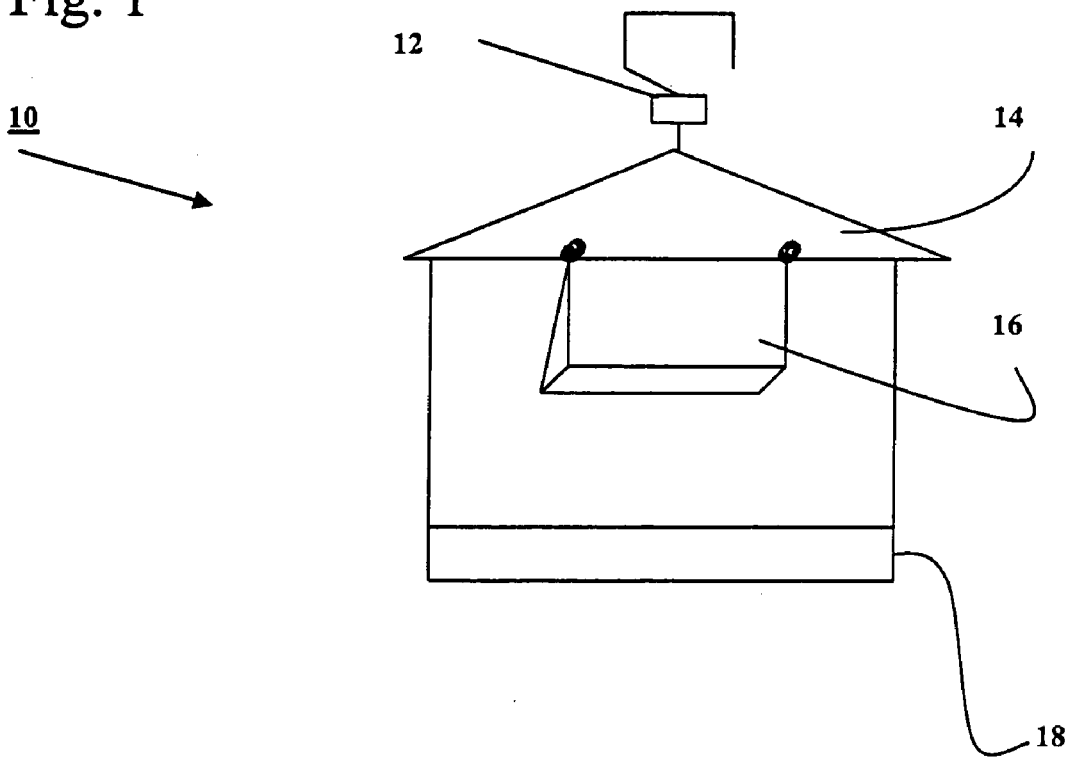
FIG. 1 is a side view of an improved clothing hanger with the parts delineated in the attached parts list.
Figure 2:
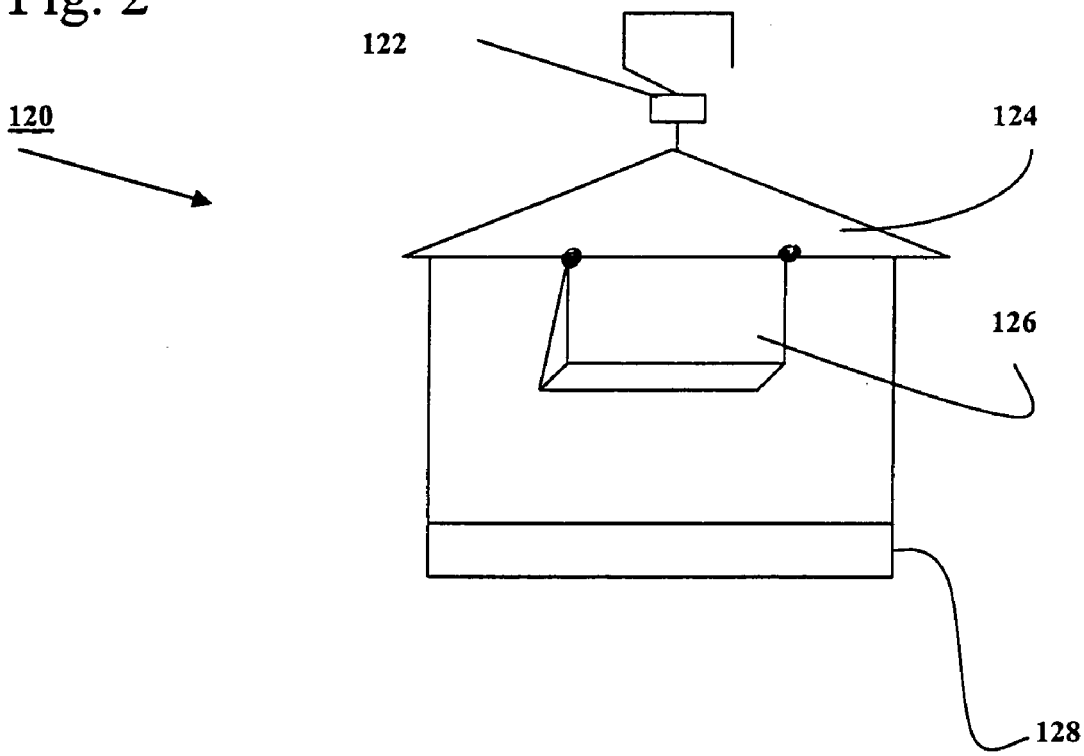
FIG. 2 is a side view of a second improved clothing hanger with the parts delineated in the attached parts list.

The Improved Clothing Hanger Adapted For Personal Use invention is generally shown in FIG. 1 and FIG. 2. The subject invention can be 10 a single purpose clothes hanger apparatus and structure having text messaging appendages 12 extending laterally outwardly from the upper neck portion of the hanger. An upper clothing hanger frame member 14 and at least one additional horizontal bar 18 from which additional articles of clothing can be attached or hanged, each such bar comprises a linear horizontal extending member equilaterally affixed below the neck portion of the hanger, the customary horizontal bar member being adapted with a receptacle 16 such as a clear, netting, or transparent paper disposable bag for containing and exposing underwear, ties, scarves, socks, and the like. The text messaging appendages are adapted to indicate to the wearer or his or her valet, caregiver, a child, or a childcare provider the day of the week for which the garments attached to hanger are to be used along with related clothing and/or other instructions pertinent to the wearer.

The wording in the instruction tag 12 may be used to identify the garments for the individual who can no longer remember how to select clothing. Parents can also use the hanger to plan a child's clothing for the week as well as weather related alternatives. It eases the burden for the caregivers. The novel invention and combination of features provides a tool to enable caregivers to organize clothing sets for a full week, and know that the individual will have clean and coordinated clothing. Another aspect of the invention is a method of use of the structure to enable color blind and blind individuals to wear coordinated clothing. The use of the novel structure time shifts and time concentrates the selection process so that the caregiver can perform the selection and assembly services in a defined time period such as one day or evening per week. This is a valuable and viable service to those who require assistance with coordinating clothing or for those who prefer valets to do this task.

FIG. 2 shows a second 120 Improved Clothing Hanger Adapted for Personal Use which can be used in connection with one or more other Improved Clothing Hangers for Personal Use. The subject invention can be a single purpose clothes hanger apparatus and structure having text messaging appendages 122 extending laterally outwardly from the upper neck portion of the hanger. An upper clothing hanger frame member 124 and at least one additional horizontal bar 128 from which additional articles of clothing can be attached or hanged, each such bar comprises a linear horizontal extending member equilaterally affixed below the neck portion of the hanger, the customary horizontal bar member being adapted with a receptacle 126 such as a clear, netting, or transparent paper disposable bag for containing and exposing underwear, ties, scarves, socks, and the like. The text messaging appendages are adapted to indicate to the wearer or his or her valet, care giver, a child, or a childcare provider the day of the week for which the garments attached to hanger are to be used along with related clothing and/or other instructions pertinent to the wearer.

While there has been shown and described a preferred embodiment of an improved clothing hanger structure for use by children, valets, or to assist mentally impaired persons in daily dressing and coordination of their clothing in accordance with the invention, it will be appreciated that many changes and modifications may be made therein without, however, departing from the essential spirit thereof, and it is therefore desired that the present embodiment be considered in all respects as illustrative and not restrictive, reference being made to the appended claims rather than to the foregoing description to indicate the scope of the invention.

What is claimed is:

1. An improved clothing hanger, the clothes hanger marked to indicate a specific day of the week, adapted for personal use comprising a triangular rigid upper part adapted to receive a shirt, coat, blouse or the like, the upper part having attached thereto a closet rod hanging means or hook, the hook having attached thereto a text messaging means wherein the messaging means comprises a communications module actuated manually or by motion or by exposure to a selected light intensity and is an electronic digital voice recorder with a recorded instructional message, wherein the electronic communications module is a wireless digital receiver and audio transmitter adapted to receive and repeatedly play a pre-recorded message wirelessly transmitted from a wireless digital signal source, wherein the wireless digital signal source is a computer connected to a wireless network, and wherein the electronic communications module is connected to a wireless network for communicating instructions to a child or an impaired person for dressing using clothing on the hanger and in a transparent or translucent container means detachably connected to the upper part, the container means being adapted to hold articles of clothing such as underwear, belts, scarves, socks and the like, at least one horizontal bar attached to the upper part and located underneath the container means, the horizontal bar being adapted to support a pair of trousers, a dress, a skirt, or a plurality of such items.

2. An improved method for coordinating a process of dressing a child or an impaired person comprising the step of using the hanger described in claim 1.

3. An improved disposable clothing hanger adapted for personal use comprising a triangular rigid upper part adapted to receive a shirt, coat, blouse or the like, the upper part having attached thereto a closet rod hanging means or hook, the hook having attached thereto a text messaging means for communicating instructions to a person, a transparent or translucent container means detachably connected to the upper part, the container means being adapted to hold articles of clothing such as underwear, belts, scarves, socks and the like, at least one horizontal bar attached to the upper part and located underneath the container means, the horizontal bar being adapted to support a pair of trousers, a dress, a skirt, the clothes hanger marked to indicate a specific day, the clothing hanger comprising a rigid upper part and a rigid lower part attached to the upper part, the upper part having attached thereto a hanging means for hanging said hanger, a transparent container detachably connected to the clothing hanger, the lower part comprising a horizontal bar for supporting clothing, the hanging means having attached thereto a messaging means for communicating instructions to a person for dressing using clothing on the hanger and in the transparent container, the messaging means further comprising a communications module actuated by motion, the communications module being an electronic digital voice recorder with a recorded instructional message in a voice familiar to the user, the electronic communications module being a wireless digital receiver and audio transmitter adapted to receive and repeatedly play a pre-recorded message wirelessly transmitted from a wireless digital signal source, the wireless digital signal source being a home computer connected to a wireless network, the electronic communications module being connected to said wireless network, the communications module being manually actuated and automatically activated by exposure to a selected light intensity.

* * * * *